US009562308B2

(12) United States Patent
Barea

(10) Patent No.: US 9,562,308 B2
(45) Date of Patent: Feb. 7, 2017

(54) DEVICE FOR FEEDING YARN TO A TEXTILE MACHINE

(71) Applicant: Tiziano Barea, Busto Arsizio (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 305 days.

(21) Appl. No.: 14/353,867

(22) PCT Filed: Dec. 12, 2012

(86) PCT No.: PCT/IB2012/002712
§ 371 (c)(1),
(2) Date: Apr. 24, 2014

(87) PCT Pub. No.: WO2013/088233
PCT Pub. Date: Jun. 20, 2013

(65) Prior Publication Data

US 2014/0291435 A1 Oct. 2, 2014

(30) Foreign Application Priority Data

Dec. 15, 2011 (IT) ..... MI2011A2267

(51) Int. Cl.
*D04B 15/48* (2006.01)
*D03D 47/36* (2006.01)
*B65H 51/22* (2006.01)

(52) U.S. Cl.
CPC ..... *D04B 15/482* (2013.01); *B65H 51/22* (2013.01); *D03D 47/363* (2013.01); *D03D 47/364* (2013.01); *D04B 15/484* (2013.01)

(58) Field of Classification Search
CPC .... B65H 51/22; D03D 47/362; D03D 47/363; D03D 47/364; D04B 15/482; D04B 15/484; D04B 15/50
See application file for complete search history.

(56) References Cited

U.S. PATENT DOCUMENTS 3,637,149 A 1/1972 Frei
3,796,385 A 3/1974 Jacobsson
(Continued)

FOREIGN PATENT DOCUMENTS

DE 4104087 A1 8/1991
DE 4313255 A1 10/1994
(Continued)

OTHER PUBLICATIONS

U.S. Appl. No. 14/353,728 to Tiziano Barea, "Positive Feeder Device for Feeding Metal Wires at Constant Tension," filed Apr. 23, 2014. (US National Stage of WO 2013/064879 A1).
(Continued)

*Primary Examiner* — William E Dondero
(74) *Attorney, Agent, or Firm* — Vorys, Sater, Seymour and Pease LLP

(57) ABSTRACT

A device for feeding yarn to a textile machine, including a main body defining an entry portion and an exit portion for yarn; a rotatable drum for winding the yarn originating from the entry portion and a motor connected to the drum for rotating the drum; a control member active at least on the motor to regulate its torque and velocity; exit portion being selectively switchable between a first configuration in which it defines a free exit section for the yarn, through which the exiting yarn defines a closed path about a rotation axis of the drum, and a second configuration in which it defines a limited exit section, through which the exiting yarn defines an open path.

20 Claims, 4 Drawing Sheets

(56) References Cited

U.S. PATENT DOCUMENTS

| | | | | |
|---|---|---|---|---|
| 3,843,069 | A | 10/1974 | Deniega et al. | |
| 3,883,083 | A | 5/1975 | Rosen | |
| 3,908,921 | A | 9/1975 | Jacobsson | |
| 4,047,398 | A | 9/1977 | Fecker et al. | |
| 4,180,215 | A | 12/1979 | Nurk | |
| 4,852,617 | A | 8/1989 | Hamer et al. | |
| 5,240,194 | A | 8/1993 | Noirot et al. | |
| 5,421,534 | A | 6/1995 | Arnold et al. | |
| 5,570,593 | A * | 11/1996 | Neher | D04B 15/482 242/364.5 |
| 5,740,974 | A | 4/1998 | Conzelmann | |
| 2008/0210804 | A1 | 9/2008 | Barea | |
| 2008/0296425 | A1 | 12/2008 | Comotto et al. | |
| 2009/0178757 | A1 | 7/2009 | Cocovi et al. | |
| 2012/0037601 | A1 | 2/2012 | Watanabe et al. | |

FOREIGN PATENT DOCUMENTS

| | | | |
|---|---|---|---|
| DE | 102004020465 | B3 | 9/2005 |
| EP | 0424770 | A2 | 5/1991 |
| EP | 0652312 | A1 | 5/1995 |
| EP | 2014809 | A1 | 1/2009 |
| EP | 2031610 | A1 | 3/2009 |
| FR | 2655888 | A1 | 6/1991 |
| GB | 1236821 | A | 6/1971 |
| JP | S49-124361 | A | 11/1974 |
| JP | H11-511426 | A | 10/1999 |
| JP | 2011-12381 | A | 1/2011 |
| WO | 97/11903 | A2 | 4/1997 |
| WO | 2006133662 | A1 | 12/2006 |
| WO | 2007006411 | A1 | 1/2007 |
| WO | 2007048528 | A1 | 5/2007 |
| WO | 2007096765 | A1 | 8/2007 |
| WO | 2010116412 | A1 | 10/2010 |
| WO | 2013/064879 | A1 | 5/2013 |
| WO | 2013/072736 | A1 | 5/2013 |
| WO | 2013/093592 | A1 | 6/2013 |
| WO | 2013/098631 | A1 | 7/2013 |

OTHER PUBLICATIONS

U.S. Appl. No. 14/353,806 to Tiziano Barea, "Yarn Feeder of Storage Type With Magnetic Brake," filed Apr. 24, 2014. (US National Stage of WO 2013/072736 A1).

U.S. Appl. No. 14/354,211 to Tiziano Barea, "Method and Device for Storing Yarn in Order to Feed Thread Without Creating Twisting Thereof," filed Apr. 25, 2014. (US National Stage of WO 2013/093592 A1).

U.S. Appl. No. 14/354,279 to Tiziano Barea, "System and Method for Feeding Metal Wires at Constant Tension," filed Apr. 25, 2014. (US National Stage of WO 2013/098631 A1).

Chinese Office Action and Search Report of Jan. 20, 2015 from CN Patent Application No. 201280062219.3 to BTSR International S.p.A.

Japanese Office Action of May 26, 2015 from JP Patent Application No. 2014-543990 to BTSR International S.p.A.

International Search Report mailed Mar. 8, 2013 for PCT/IB2012/002712 to BTSR International S.P.A. filed Dec. 12, 2012.

* cited by examiner

DEVICE FOR FEEDING YARN TO A TEXTILE MACHINE

CROSS-REFERENCE TO RELATED APPLICATIONS

This is a §371 National Stage Application of International Application No. PCT/IB2012/002712 filed on 12 Dec. 2012, claiming the priority of Italian Patent Application No. MI2011A002267 filed on 15 Dec. 2011.

The present invention relates to a device for feeding yarn to a textile machine in accordance with the introduction to the main claim.

A feed device is known comprising a rotatable drum driven by a suitable motor and on which a yarn originating from a spool is wound. In particular, a predetermined number of yarn turns are wound on the drum.

The textile machine freely withdraws from the device the yarn wound on the drum. It should be noted that in this case, the drum does not have to be rotated during the feed as the yarn is withdrawn from the drum by the pulling action of the textile machine alone. In this respect, this type of feed device is known as "negative action" type.

Evidently, the velocity with which the yarn is wound on the drum can be different from the velocity with which the yarn is unwound from the drum. In other words, the drum assumes the function of a yarn store, the feed device being of storage type, with the control electronics operating the motor such that at least a minimum store of yarn is always present on the drum.

Downstream of the drum, the known device comprises a tensioning member (for example an annular comb or an annular brush) the pressure of which on the drum confers an average tension on the yarn.

This type of feed device presents however certain drawbacks:

Firstly the known device does not provide for any control and regulation of the yarn tension, and is therefore not a closed loop system able to correct any errors. In effect, the yarn tension is simply maintained within a range of acceptable values by virtue of the action of the tensioning member alone; in fact, any wear of the tensioning member determines a variation in the yarn tension which the device is unable to compensate.

The described device is hence unable to overcome the problem of controlling and regulating the yarn tension, which is fundamentally important for ensuring the finished product quality, in particular in the case of elastic yarns. A further drawback of the described known device relates to the fact that the tensioning member acts mechanically on the yarn to exert a pressure thereon which, in particular for certain yarn types can determine damage to the yarn or a loss of its special characteristics (covered elastic yarns, . . . ).

A yarn feed device of so-called "positive action" type is also known.

This device comprises a rotary motorized drum on which the yarn originating from a spool is wound.

In this case the drum is also rotated during the yarn feed to the textile machine. In other words, it is the drum itself which, by rotating, unwinds successive yarn turns directed to the textile machine.

In this case, the known device comprises a tension sensor positioned downstream of the drum to evaluate the tension of the yarn fed to the textile machine.

The measured tension value is then compared with a predefined reference value. The yarn tension is then regulated by modifying the drum rotation velocity. In particular, the drum is decelerated to increase the measured tension to the reference value, or is accelerated to reduce the measured tension to the reference value.

Although this type of feed device enables the yarn tension to be controlled and regulated, it does not always guarantee that optimal quality of the final product.

For example, this device presents significant limits in the case in which the textile machine operates discontinuously during the production process.

In this respect, because of system inertia, if faced by a sudden increase in yarn requirement by the textile machine, the device can only respond late because of the system dynamics to such a yarn request, hence subjecting the yarn to excessive tension which can damage or break it, causing defects and quality loss in the finished product.

In this context, the technical aim on which the present invention is based is to propose a device for feeding yarn to a textile machine which overcomes the aforestated drawbacks of the known art.

A particular object of the present invention is to provide a device for feeding yarn to a textile machine which is extremely versatile and easily adaptable to different production requirements and/or different yarn types.

The stated technical aim and the specified object are substantially attained by a device for feeding yarn to a textile machine comprising the technical characteristics disclosed herein.

Further characteristics and advantages of the present invention will be more apparent from the indicative and therefore non-limiting description of a preferred but non-exclusive embodiment of a device for feeding yarn to a textile machine, as illustrated in the accompanying drawings, in which.

Figure 1:
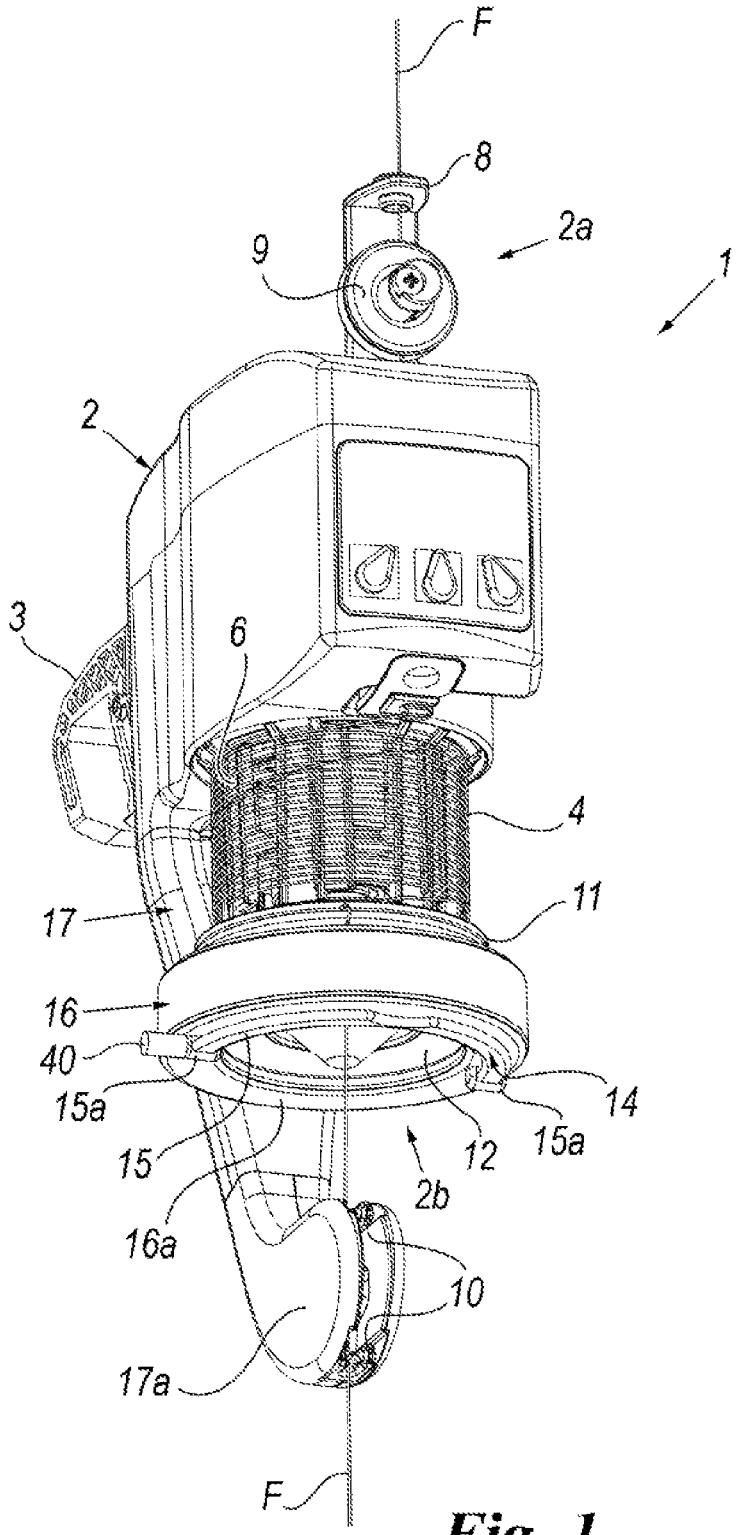
FIG. 1 is a perspective view of a device for feeding yarn to a textile machine in accordance with the present invention, shown in a first operative configuration.

With reference to said figures, a feed device in accordance with the invention is indicated overall by 1 and comprises a main body 2 provided with a bracket 3 for fixing the device to a support (not shown) associated with a textile machine (not shown) or in proximity to this latter.

The main body 2 presents an entry portion 2*a* for a yarn F originating from a spool not shown in the figures, and an exit portion 2*b* for the yarn F directed towards the textile machine.

The body 2 carries a rotary member or drum 4 driven (in any known manner) by its own motor or electrical actuator 5 contained in the body 2. The drum 4 is hence positioned between the entry portion 2*a* and the exit portion 2*b* of the main body 2.

The yarn F winds onto the drum 4 when rotated, to form a plurality of turns 6, before leaving the main body 2 to reach the textile machine.

A control member, preferably of microprocessor type, is operationally connected to the motor 5 to control its rotation velocity.

In greater detail, the drum 4 presents a rotation axis R which, when in use, is disposed substantially vertical.

In the described embodiment, the entry portion 2*a* lies at a greater height than the drum 4. The exit portion 2*b* lies at a lesser height than the drum 4 and is preferably aligned with the rotation axis R.

At the entry portion 2*a* for the yarn F, the device 1 comprises one or more inlet thread guides 8 (only one shown in the figures), for example of ceramic, which define the trajectory of entry into the main body 2, such as to prevent the yarn F from undergoing tangling, damage or overtensions deleterious for the good operation of the device 1, and for correct feed of the yarn F to the textile machine.

Preferably, the feed device 1 also presents a yarn brake 9 in the entry portion 2*a*.

Figure 3:
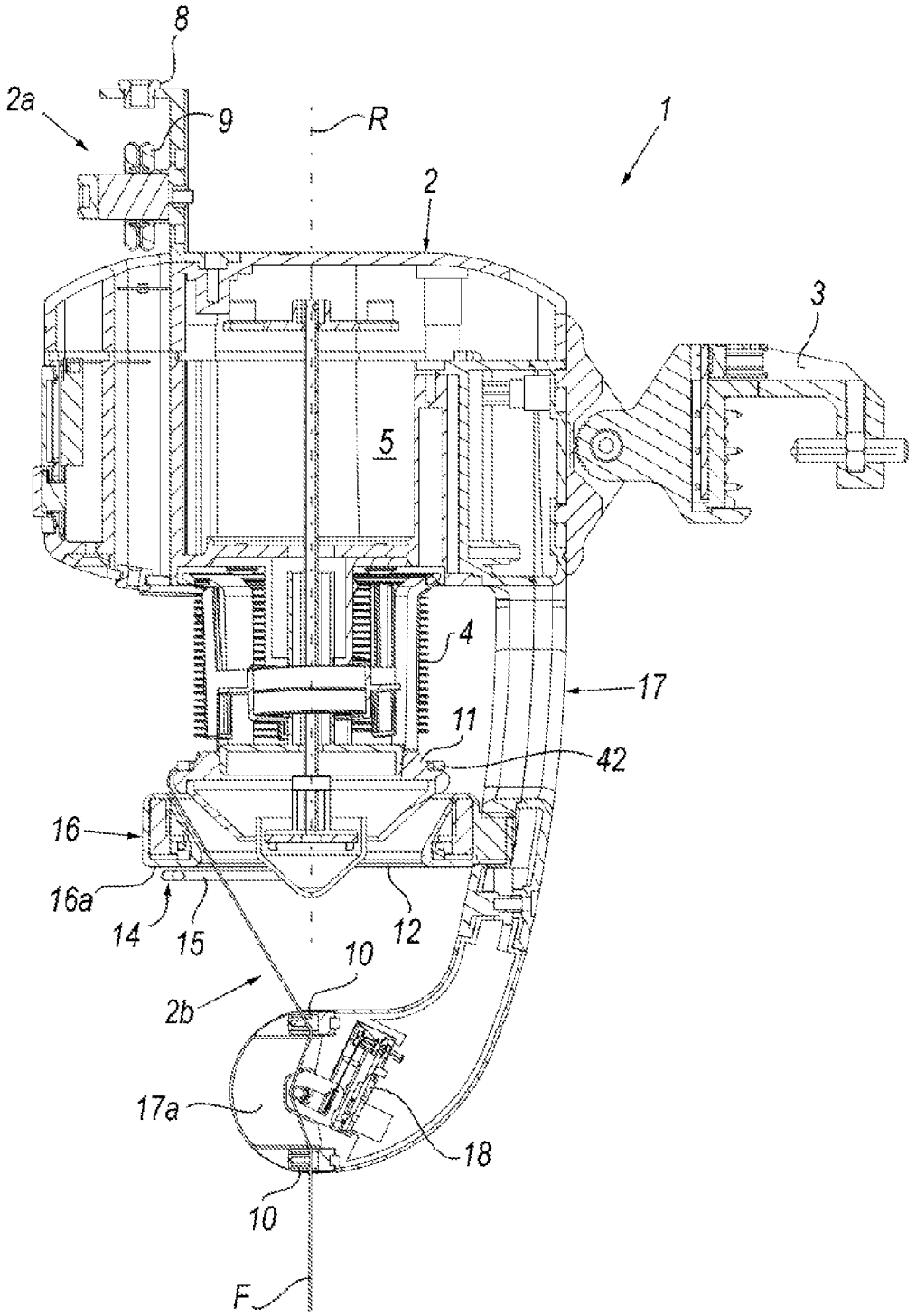
FIG. 3 is a lateral section through the yarn feed device of FIG. 1, shown in the first operative configuration.
Figure 4:
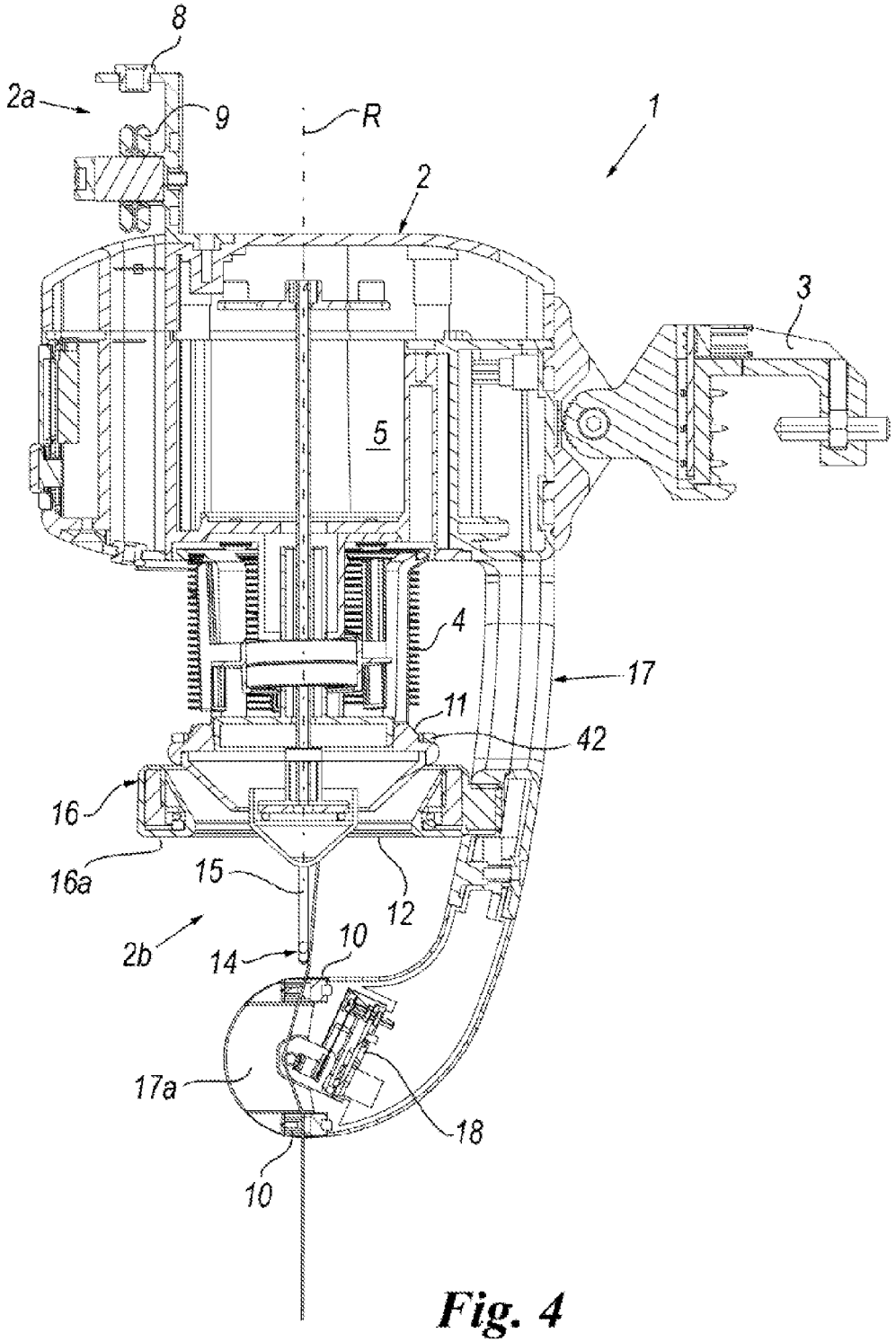
FIG. 4 is a lateral section through the yarn feed device of FIG. 1, shown in the second operative configuration.

At the exit portion 2*b*, the main body 2 presents one or more exit thread guides 10. In FIGS. 3 and 4, two exit thread guides 10 are shown, aligned with the rotation axis R.

In detail, The exit thread guide 10 is housed at the end 17*a* of a protuberance 17 emerging from the main body 2.

In accordance with that shown, the exit thread guide 10 is aligned with the rotation axis R of the drum 4.

The drum 4 lies resting on a support ring 11 juttingly retained on the main body 2 and coaxial with the rotation axis R.

Hence the yarn F, leaving the main body 2 and withdrawing from the drum 4, rests on the support ring 11 and is directed towards the exit thread guide 10.

Figure 2:
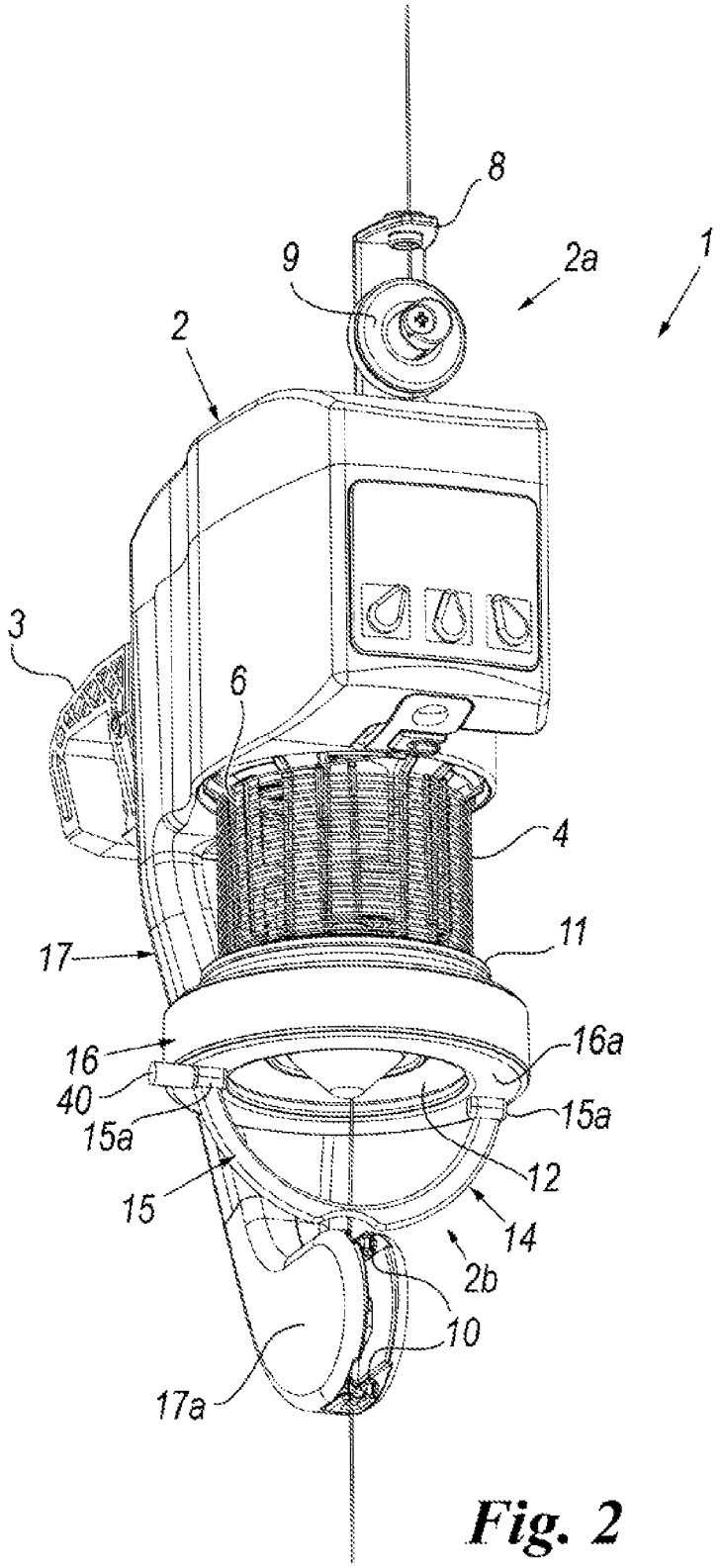
FIG. 2 is a perspective view of the yarn feed device of FIG. 1, shown in a second operative configuration.

In accordance with the present invention, the exit portion 2*b* is selectively switchable between a first configuration (FIGS. 1 and 3), in which it defines a free exit section 12 for the yarn F through which the exiting yarn F defines a closed path about the rotation axis R, and a second configuration (FIGS. 2 and 4) in which it defines a limited exit section 12 through which the exiting yarn F defines an open path.

In greater detail, the path defined by the exit section 12 is defined as the intersection of the exiting yarn F with a plane perpendicular to the rotation axis R of the drum 4.

In the first configuration, the free exit section 12 has a substantially annular shape. This means that the yarn F unwinding from the drum 4 undergoes complete revolutions about the rotation axis R while resting on the support ring 11. During the unwinding, the yarn F hence defines a cone having its base corresponding to the support ring 11 and its vertex positioned at the exit thread guide 10.

In the first configuration, the control member pilots and controls the velocity of the motor 5 in order to maintain on the drum 4 at least a minimum stock of yarn, preferably to maintain this stock constant, rotation velocity of the drum 4 hence not being related to the yarn feed velocity dictated by the textile machine.

In the first configuration, the feed device 1 is of the "negative action" type.

As the velocity with which the yarn is wound onto the drum 4 is independent and can be different from the velocity with which the yarn F is unwound, the feed device 1 in the first configuration is also known as of "storage" type.

In contrast, in the second configuration, the exit section 12 is limited or, in other words, obstructed. In other words, the yarn F exiting the drum 4 defines an open path. Moreover, the yarn F unwinding from the drum 4 undergoes incomplete revolutions about the rotation axis R while resting on the support ring 11. For example, this path defined by the limited exit section 12 can present a circumferential arc shape. Alternatively, the path defined by the exit section 12 can present a pointed shape or can be a closed path in which the rotation axis R is external to the path.

In the second configuration, the control member controls the rotation velocity of the motor 5. In other words, in this configuration the motor 5 and the drum 4 are rotating to supply the quantity of yarn F requested by the textile machine.

In greater detail, the feed device 1 comprises a blocking member 14 which substantially modifies the shape of the exit portion 2*b* in the first and in the second configuration.

The blocking member 14 is positioned on the exit portion 2*b* and is reversibly movable between a first position, in which it determines the first described configuration, and a second position, in which it determines the second described configuration.

As shown, the blocking member 14 comprises an appendix 15 secured to the main body 2 at its opposing ends 15*a*. In greater detail, the appendix 15 is rotatably coupled to the main body 2.

The main body 2 comprises an annular part 16 disposed coaxial to the rotation axis R and secured to the rest of the main body 2 via the protuberance 17. The annular part 16 presents a frusto-conical internal surface which facilitates passage of the yarn F from the support ring 11 to the exit thread guide 10.

As shown, the appendix 15 is hinged to the annular part 16. In greater detail, the appendix 15 is hinged to a base surface 16*a*, preferably flat and facing the end 17*a* of the protuberance 17 of the annular part 16.

When the blocking member 14 is in the first position, the appendix 15 lies in a plane substantially perpendicular to the rotation axis R (FIG. 3). In other words, the appendix 15 lies resting on the annular part 16 and in particular on the base surface 16*a* of the annular part 16.

In this case, the appendix does not interfere in any manner with the exiting of the yarn F and this latter is able to be unwound about the rotation axis R without operating the motor 5, the device hence being in the negative working mode.

When the blocking member 14 is in the second position, the appendix 15 lies in a plane substantially transverse to the plane perpendicular to the rotation axis R (FIG. 4). In other words, the appendix 15 is inclined to the base surface 16*a* of the annular part 16.

In contrast, in this case the appendix 15 constitutes an obstacle to the exiting of the yarn F, which is unable to be unwound by rotating freely about the rotation axis R. To enable the yarn F to exit, the motor 5 must be activated and the drum 4 rotated, the device hence being in the positive working mode. Switching between the first and second position of the blocking member 14 can be manual.

Alternatively and advantageously, the feed device 1 can comprise an actuator 40 connected to the appendix 15 to reversibly move the blocking member 14 between the first position and second position.

Advantageously, the control member is functionally associated with said actuator to command the movement of the appendix 15.

Advantageously, the feed device 1 comprises a tension sensor 18 disposed downstream of the exit portion 2*b*, the tension sensor 18 preferably being of known type.

In detail, the tension sensor 18 is disposed in the end 17*a* of the protuberance 17 and is aligned with the rotation axis R. Preferably, the exit thread guide 10 is associated with the tension sensor 18.

The tension sensor 18 is operationally connected to the control member and is preferably active both when the exit portion 2*b* is in the first configuration and when in the second configuration.

In this respect, advantageously the feed device 1 also comprises tensioning means 42 disposed downstream of the drum 4 and active on the yarn F. In particular, the tensioning means act on the yarn F when the exit portion 2*b* is in the first configuration.

Preferably, these tensioning means are adjustable such as to increase or decrease the yarn tension with respect to a reference value. For example, the tensioning means comprise a brake which acts directly by friction on the yarn F.

The tensioning means are operationally connected to the control member.

In this respect, when the exit portion 2*b* is in the first configuration, the tension 18 generates a tension signal representative of the tension measurement on the yarn F exiting the feed device 1. The tension signal is fed to the control member which, once received, compares it with a preset reference tension value.

Based on this comparison, the control member generates a regulation signal and feeds it to the tensioning means to consequently vary the tension applied to the yarn F until the reference value is attained.

When the exit portion 2*b* is in the second configuration, the sensor generates a tension signal representative of the tension measurement on the yarn F exiting the feed device 1. The tension signal is fed to the control member which, once received, compares it with a preset reference tension value.

Based on this comparison, the control member generates a torque signal and feeds it to the motor 5. The torque signal is representative of the torque which the motor 5 has to generate on the drum 4 and consequently of its velocity.

In greater detail, if the measured tension of the yarn F is greater than the reference value, the torque exerted by the motor 5 on the drum 4 must be increased to increase the delivery rate of the yarn F and reduce its tension to the reference value.

Vice versa, if the measured tension of the yarn F is less than the reference value, the torque exerted by the motor 5 on the drum 4 must be decreased to decrease the delivery rate of the yarn F and increase its tension to the reference value.

The invention described in this manner overcomes the proposed problem.

In this respect, the described feed device can operate in accordance with two easily switchable configurations.

In detail, it can operate either as a "passive" feeder or as an "active" feeder, depending on the operative conditions concerned.

When, for example, very precise control of the yarn tension is required, such as for elastic yarns, the operator can choose the second configuration of the exit portion, whereas if the textile machine is to operate discontinuously, the operator can choose the first configuration.

The so described feeding device is thus easily adaptable to operating conditions very different from each other.

The invention claimed is:

1. A device for feeding yarn to a textile machine, comprising:

a main body defining an entry portion and an exit portion for the yarn;

a rotatable drum associated with said main body, said rotatable drum configured for winding said yarn received from said entry portion;

a motor associated with said main body, the motor connected to said drum to rotate said drum;

a control member configured to control said motor and regulate said motor's torque and velocity said exit portion being selectively switchable between a first configuration in which said exit portion defines a free exit section for the yarn, through which the exiting yarn undergoes a complete revolution about a rotation axis R of the drum defining a closed path about a rotation axis of said drum, and a second configuration in which said exiting yarn undergoes an incomplete revolution about the rotation axis R of the drum defining an open path;

wherein said control member is configured to control and regulate the velocity of said motor for the purpose of maintaining a stock of yarn on the drum when said exit portion is in the first configuration and instead maintaining the tension of the yarn being fed from the device to the textile machine constant and independent of the operation of the textile machine when said exit portion is in the second configuration.

2. A device as claimed in claim 1, further comprising a blocking member positioned on the exit portion for the yarn and movable between a first position corresponding to the first configuration of the exit portion and a second position corresponding to the second configuration of the exit portion.

3. A device as claimed in claim 2, wherein said blocking member comprises a semi-annular appendix rotatably constrained to said main body at opposing ends of the semi-annular appendix.

4. A device as claimed in claim 3, wherein said appendix lies in a plane substantially perpendicular to a rotation axis of the drum when in said first position and lies in a plane transverse to a plane perpendicular to said rotation axis when in said second position.

5. A device as claimed in claim 4, comprising an actuator connected to said appendix to reversibly move said blocking member between said first and said second position.

6. A device as claimed in claim 5, wherein said control member is also active on said actuator to command the switching of said blocking member.

7. A device as claimed in claim 5, wherein, when said exit portion is in the second configuration, a tension sensor is arranged to generate a tension signal representative of the tension measurement on the exiting yarn; said control member receiving said tension signal and generating a corresponding torque signal representative of the torque delivered by said motor.

8. A device as claimed in claim 4, wherein said blocking member is switchable manually by an operator between the first and the second position.

9. A device as claimed in claim 3, comprising an actuator connected to said appendix to reversibly move said blocking member between said first and said second position.

10. A device as claimed in claim 9, wherein said control member is also active on said actuator to command the switching of said blocking member.

11. A device as claimed in claim 3, wherein said blocking member is a manually actuated blocking member switching between the first and the second position.

12. A device as claimed in claim 2, comprising a tension sensor disposed downstream of the exit portion.

13. A device as claimed in claim 2, comprising a tensioner disposed downstream of the drum and active on the yarn when said exit portion assumes said first configuration.

14. A device as claimed in claim 13, wherein when said exit portion is in the first configuration, a tension sensor is arranged to generate a tension signal representative of the tension measurement on the exiting yarn; said control member receiving said tension signal and generating a corresponding regulation signal then feeding it to said tensioner.

15. A device as claimed in claim 1, comprising a tension sensor disposed downstream of the exit portion.

16. A device as claimed in claim 15, wherein, when said exit portion is in the second configuration, said tension sensor is arranged to generate a tension signal representative of the tension measurement on the exiting yarn; said control member receiving said tension signal and generating a corresponding torque signal representative of the torque delivered by said motor.

17. A device as claimed in claim 1, comprising a tensioner disposed downstream of the drum and active on the yarn when said exit portion assumes said first configuration.

18. A device as claimed in claim 17, wherein when said exit portion is in the first configuration, a tension sensor is arranged to generate a tension signal representative of the tension measurement on the exiting yarn; said control member receiving said tension signal and generating a corresponding regulation signal then feeding it to said tensioner.

19. The device as claimed in claim 1, wherein the exit port is defined by an annular part located below said rotatable drum, at least one exit thread guide located between the annular part, and a selectively movable blocking member operating between the annular part and the at least one exit thread guide and configured to selectively switch the exit portion between the first configuration and the second configuration.

20. A device for feeding yarn to a textile machine, comprising:

a main body having an upper entry portion and a lower exit portion;

a rotatable drum associated with said main body and located between the upper entry portion and the lower exit portion, the rotatable drum having a vertical rotational axis and configured for receiving the yarn from the upper entry portion and then winding said yarn around the rotatable drum;

a motor associated with said main body, the motor located above the rotatable drum and connected to said drum to rotate the drum;

a control configured to control the operating of the motor;

a support ring located at a lower end of the drum, wherein the lower exit portion is defined by an annular part located below said support ring and above said lower exit portion, and a selectively movable blocking member comprising an appendix hinged to the annular part, wherein said appendix is configured to be selectively switched between a first configuration in which the appendix is oriented transversely relative to the rotational axis of the rotatable drum with the lower exit portion defining a free exit section for the yarn through which the exiting yarn undergoes a complete revolution about the rotation axis of said drum along a closed path about the rotation axis of said drum and a second configuration in which the appendix is oriented vertically downwardly along the rotational axis of the rotatable drum with the exit portion then defining a limited exit section for the yarn through which the exiting yarn undergoes an incomplete revolution about the rotation axis of the drum along an open path; and wherein the control is configured to control and regulate the velocity of the motor for the purpose of maintaining a stock of yarn on the drum when the lower exit portion is in the first configuration and maintaining the tension of the yarn being fed from the device to the textile machine constant and independent of the operation of the textile machine when the lower exit portion is in the second configuration.

* * * * *